US008834648B2

(12) United States Patent
Fountain

(10) Patent No.: US 8,834,648 B2
(45) Date of Patent: Sep. 16, 2014

(54) DISHWASHER WITH CONTROLLED ROTATION OF LOWER SPRAY ARM

(75) Inventor: Jordan R. Fountain, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 958 days.

(21) Appl. No.: 12/908,915

(22) Filed: Oct. 21, 2010

(65) Prior Publication Data

US 2012/0097200 A1 Apr. 26, 2012

(51) Int. Cl.
*A47L 15/42* (2006.01)
*A47L 15/22* (2006.01)

(52) U.S. Cl.
CPC ..... *A47L 15/22* (2013.01); *A47L 15/4221* (2013.01); *A47L 2501/20* (2013.01); *A47L 2501/03* (2013.01)
USPC ..... 134/57 D; 134/56 D; 134/58 D

(58) Field of Classification Search
USPC ..... 134/56 D, 57 D, 58 R, 58 D
See application file for complete search history.

(56) References Cited

U.S. PATENT DOCUMENTS

| | | | | |
|---|---|---|---|---|
| 2,351,342 | A * | 6/1944 | Karlstrom | 239/750 |
| 3,698,406 | A * | 10/1972 | Sato et al. | 134/57 D |
| 5,464,482 | A | 11/1995 | Michael et al. | |
| 7,047,986 | B2 | 5/2006 | Ertle et al. | |
| 7,331,356 | B2 * | 2/2008 | VanderRoest et al. | 134/56 D |
| 7,594,513 | B2 | 9/2009 | VanderRoest et al. | |
| 2005/0022849 | A1 * | 2/2005 | Park et al. | 134/58 D |
| 2006/0054197 | A1 * | 3/2006 | Yoon et al. | 134/56 D |
| 2006/0278258 | A1 * | 12/2006 | Kara et al. | 134/56 D |
| 2010/0192995 | A1 | 8/2010 | Bertsch et al. | |

FOREIGN PATENT DOCUMENTS

| | | |
|---|---|---|
| EP | 1090579 A1 | 11/2001 |
| GB | 687824 | 2/1953 |
| GB | 962740 | 7/1964 |
| GB | 1245886 | 9/1971 |
| GB | 2151464 A | 7/1985 |

OTHER PUBLICATIONS

German Search Report for DE102011052846, Mar. 23, 2012.

* cited by examiner

*Primary Examiner* — Joseph L Perrin
*Assistant Examiner* — Kevin G Lee

(57) ABSTRACT

An automatic dishwasher having first and second sprayers located within a washtub, a diverter valve to selectively divert liquid flowing from the wash chamber between the first and second sprayers, and a drive system moving the first sprayer in the wash chamber.

8 Claims, 7 Drawing Sheets

DISHWASHER WITH CONTROLLED ROTATION OF LOWER SPRAY ARM

BACKGROUND OF THE INVENTION

Contemporary automatic dishwashers for use in a typical household include a tub and upper and lower racks or baskets for supporting soiled dishes within the tub. A spray system and a filter system are provided for re-circulating wash liquid throughout the tub to remove soils from the dishes. The dishwasher may have a controller that implements a number of pre-programmed cycles of operation to wash dishes contained in the tub.

SUMMARY OF THE INVENTION

The invention relates to an automatic dishwasher with a wash chamber for receiving dishes to be washed. The wash chamber also houses a first sprayer mounted within the wash chamber for movement within the wash chamber, a second sprayer located within the wash chamber, a liquid flow path fluidly coupling the wash chamber to the first sprayer and the second sprayer, a diverter valve located within the liquid flow path and having a valve element rotatable about a first axis of rotation between first and second positions to selectively divert liquid flowing from the wash chamber between the first and second sprayers, respectively, and a drive system moving the first sprayer in the wash chamber and having a first drive shaft rotatable about a second axis of rotation and operably coupled to the first sprayer to effect movement of the first sprayer. The first axis and second axis are coaxial to partially integrate the diverter valve and the drive system to provide a compact configuration.

DESCRIPTION OF EMBODIMENTS OF THE INVENTION

Figure 1:
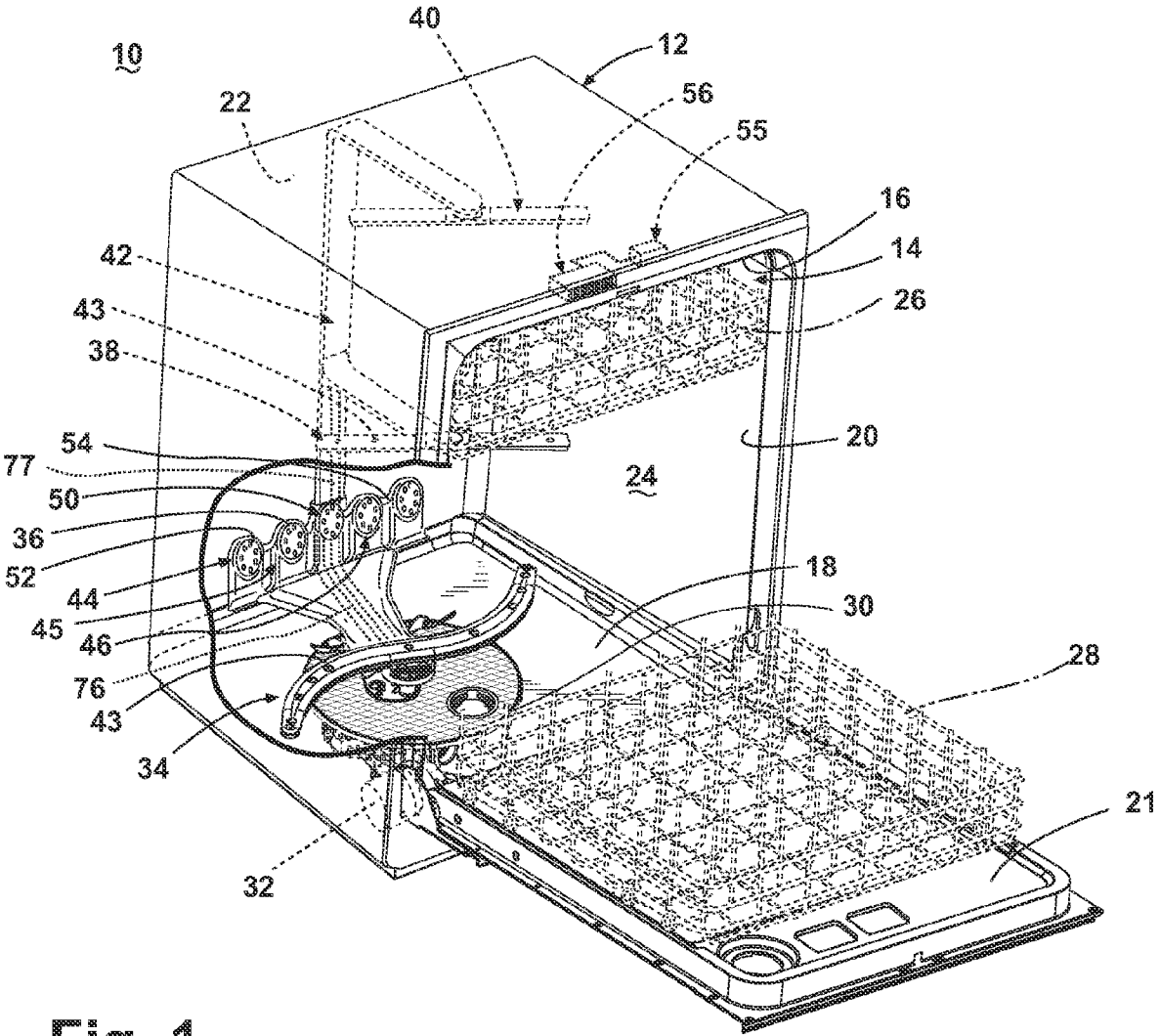
FIG. 1 is a perspective view of a dishwasher in accordance with a first embodiment of the invention.
Figure 2:
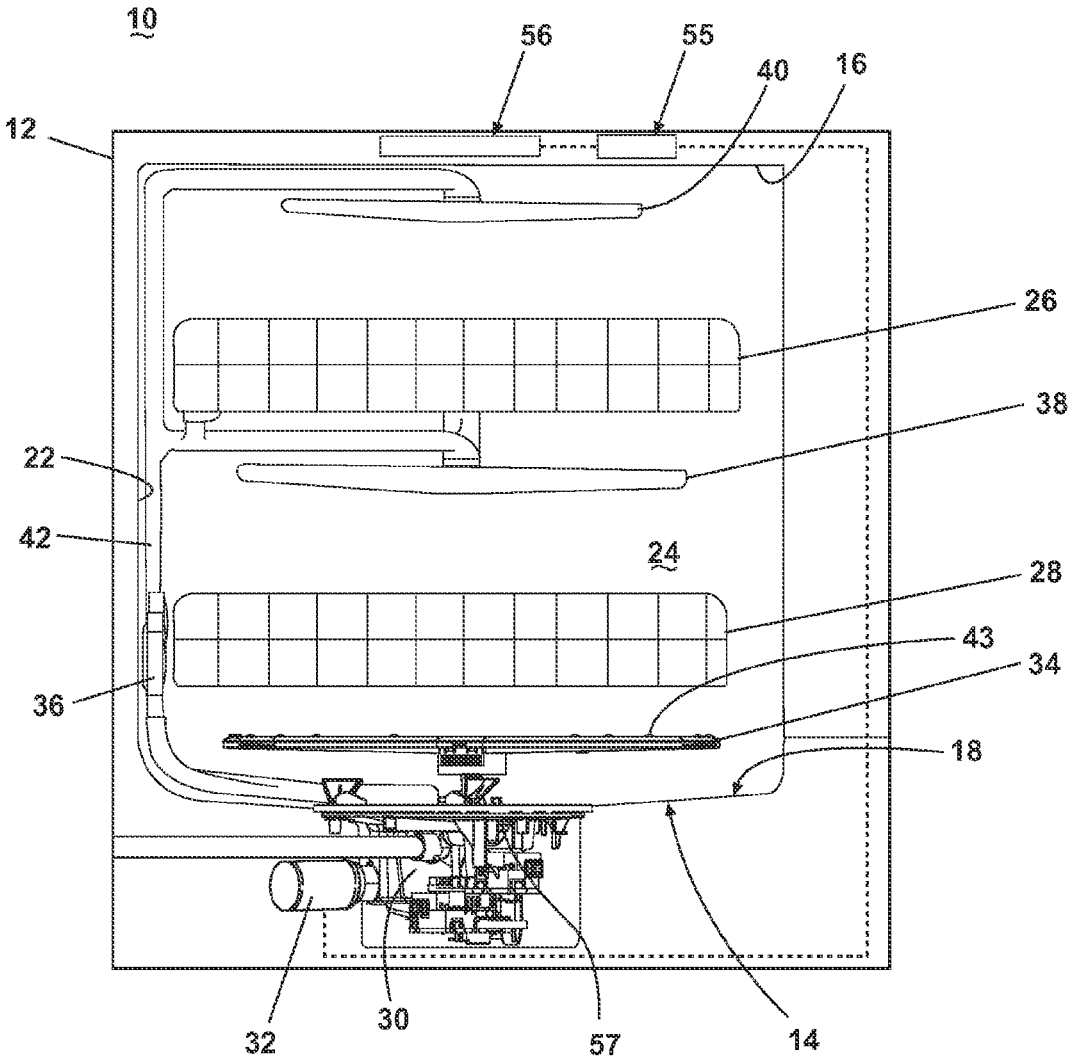
FIG. 2 is a schematic, cross-sectional view of the dishwasher shown in FIG. 1.

Referring now to FIGS. 1 and 2, a first embodiment of the invention is illustrated as an automated dishwasher 10 having a housing 12. The dishwasher 10 shares many features of a conventional automated dishwasher, which will not be described in detail herein except as necessary for a complete understanding of the invention. The housing 12 encloses a wash tub 14 having spaced top and bottom walls 16 and 18, spaced sidewalls 20, a front wall 21, and a rear wall 22. The walls 16, 18, 20, 21, and 22 collectively define a wash chamber 24 for washing utensils. As one of skill in the art will appreciate, the front wall 21 may be the door of the dishwasher 10, which may be pivotally attached to the dishwasher 10 for providing accessibility to the wash chamber 24 for loading and unloading utensils or other washable items. Utensil holders in the form of upper and lower utensil racks 26, 28 are located within the wash chamber 24 and receive utensils for washing. The upper and lower racks 26, 28 are typically mounted for slidable movement in and out of the wash chamber 24 for ease of loading and unloading. As used in this description, the term utensil may be generic to consumer articles such as dishes and the like that are washed in the dishwasher 10 and expressly includes, dishes, plates, bowls, silverware, glassware, stemware, pots, pans, and the like. While the present invention is described in terms of a conventional dishwashing unit as illustrated in FIG. 1, it could also be implemented in other types of dishwashing units such as in-sink dishwashers or drawer dishwashers.

The bottom wall 18 of the dishwasher may be sloped to define a lower tub region or sump 30 of the tub 14. A pump assembly 32 may be located in or around a portion of the bottom wall 18 and in fluid communication with the sump 30 to draw wash liquid in from the sump 30 and to pump the liquid out to at least a first lower spray assembly 34 and a second lower spray assembly 36. If the dishwasher has a rotating mid-level spray arm assembly 38 and/or an upper spray arm assembly 40, as illustrated herein, liquid may be simultaneously or selectively pumped through a supply tube 42 to each of the assemblies 38, 40 for selective spraying.

As illustrated, the first lower spray assembly 34 is positioned beneath the lower utensil rack 28. The first lower spray assembly 34 is an arm configured to rotate in the tub 14 and spray a flow of wash liquid from at least one outlet 43, in a primarily upward direction, over a portion of the interior of the wash tub 14. A first wash zone may be defined by the spray field emitted by the first lower spray assembly 34 into the wash chamber 24. The spray from the first lower spray assembly 34 is typically directed to wash utensils located in the lower utensil rack 28. The first lower spray assembly 34 may optionally also provide a liquid spray downwardly onto the sump 30, but for purposes of simplification, this will not be illustrated or described herein.

The second lower spray assembly 36 is illustrated as being located adjacent the lower rack 28 toward the rear of the wash chamber 24. The second lower spray assembly 36 is illustrated as including a vertically oriented distribution header or spray manifold 44. The spray manifold 44 may not be limited to this position; rather, the spray manifold 44 could be located in virtually any part of the wash chamber 24. Alternatively, the manifold 44 could be positioned underneath the lower rack 28, adjacent or beneath the first lower spray assembly 34. Such a spray manifold is set forth in detail in U.S. Pat. No. 7,594,513, issued Sep. 29, 2009, and titled "Multiple Wash Zone Dishwasher," which is incorporated herein by reference in its entirety. The spray manifold according to U.S. Pat. No. 7,594,513 may have two symmetrical opposing halves 45, 46 with each half 45, 46 being configured to selectively receive wash liquid. Each half 45, 46 of the manifold 44 may include a plurality of spray heads or spray nozzles 50 having apertures 52 configured to spray wash liquid into the lower rack 28. The spray nozzles 50 may be fixed or rotatable with respect to the manifold 44. Additionally, each half 45, 46 of the manifold 44 may be configured with one or more passageways 54 to deliver wash liquid to the apertures 52. The wash liquid being sprayed from the apertures 52 may be under pressure and may thereby create an intensified spray.

The second lower spray assembly 36 may be configured to spray a flow of treating liquid from the apertures 52, in a generally lateral direction, over a portion of the interior of the wash chamber 24. The spray from the apertures 52 may be typically directed to treat utensils located in the lower rack 28. A second wash zone may be defined by the spray field emitted by the second lower spray assembly 36 into the wash chamber 24. When both the first lower spray assembly 34 and the second lower spray assembly 36 emit spray fields the first and second zones may intersect.

As illustrated, the mid-level spray arm assembly 38 is positioned between the upper utensil rack 26 and the lower utensil rack 28. Like the first lower spray assembly 34, the mid-level spray arm assembly 38 may also be configured to rotate in the dishwasher 10 and spray a flow of wash liquid from at least one outlet 43, in a generally upward direction, over a portion of the interior of the wash tub 14. In this case, the spray from the mid-level spray arm assembly 38 is directed to utensils in the upper utensil rack 26. In contrast, the upper spray arm assembly 40 is positioned above the upper utensil rack 26 and generally directs a spray of wash liquid in a generally downward direction and helps wash utensils on both upper and lower utensil racks 26, 28. The wash liquid may be water, a wash aid, or any combination there of. Examples of common wash aids include: a detergent, a spot reducer, a rinse agent, a stain remover, bleach, or any other similar product that facilitates excellent cleaning of the utensils.

The sump 30, pump assembly 32, spray assemblies 34, 36, 38 and 40 and supply tube 42 collectively form a liquid flow path and recirculation system for spraying wash liquid within the wash chamber 24. The pump assembly 32 draws liquid in from the sump 30 and delivers it to one or more of the spray assemblies 34, 36, 38 and 40 through the supply tube 42, where the liquid is sprayed back into the wash chamber 24 through the spray assemblies 34, 36, 38 and 40 and drains back to the sump 30 where the process may be repeated. Thus, a liquid flow path fluidly couples the wash chamber 24 to the spray assemblies 34, 36, 38 and 40. The dishwasher 10 may further include other conventional components such as additional spray arms or nozzles, a drain pump, a filter, a heater, etc.; however, these components are not germane to the present invention and will not be described further herein.

A controller 55 may be operably coupled to the pump assembly 32 and various components of the dishwasher 10 to implement a cleaning cycle. The dishwasher 10 may be preprogrammed with a number of different cleaning cycles from which a user may select one cleaning cycle to clean a load of utensils. Examples of cleaning cycles include normal, light/china, heavy/pots and pans, and rinse only. A control panel or user interface 56 provided on the dishwasher 10 and coupled to the controller 55 may be used to select a cleaning cycle. The user interface 56 may be provided on the housing 12 or on the outer panel of the door and can include operational controls such as dials, lights, switches, and displays enabling a user to input commands to the controller 55 and receive information about the selected cleaning cycle. Alternately, the cleaning cycle may be automatically selected by the controller 55 based on soil levels sensed by the dishwasher 10 to optimize the cleaning performance of the dishwasher 10 for a particular load of utensils.

Figure 3:
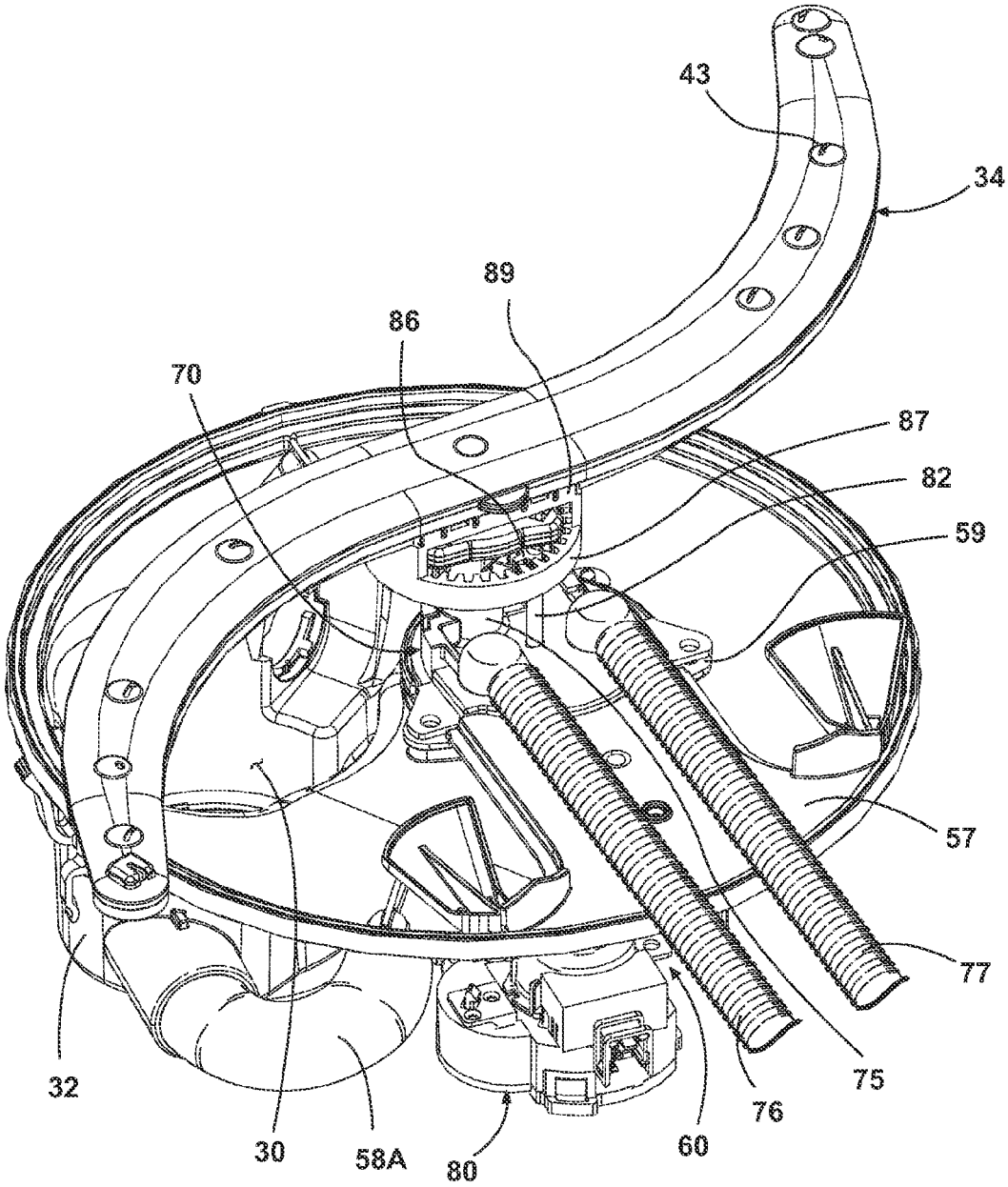
FIG. 3 is a more detailed perspective view of a portion of the dishwasher of FIG. 1 including a sump, a pump assembly, a first lower spray assembly, drive systems, and a valve assembly.
Figure 4:
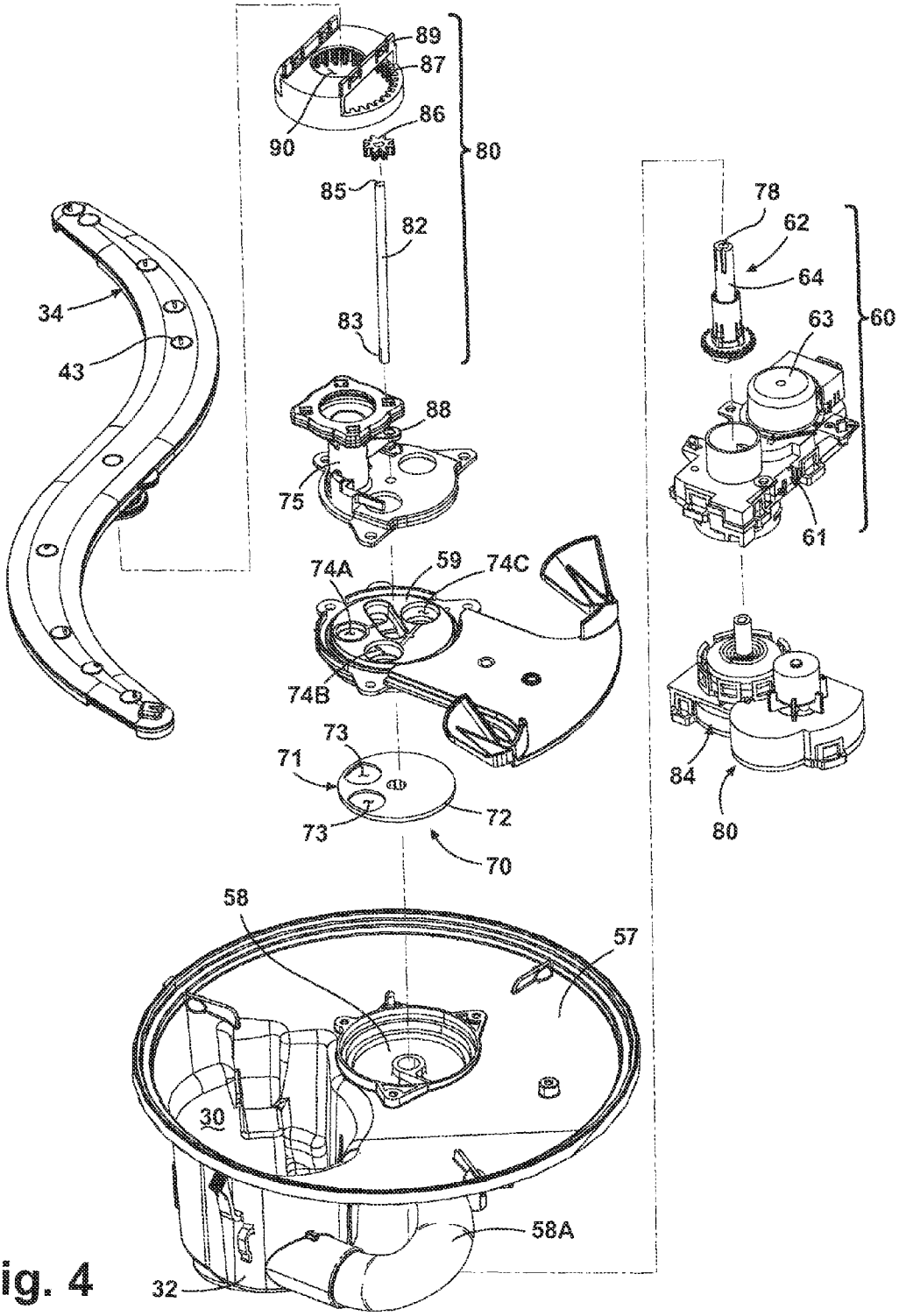
FIG. 4 is an exploded view of the drive systems and valve assembly illustrated in FIG. 3.

FIGS. 3 and 4 illustrate the sump 30, pump assembly 32, and first lower spray assembly 34 in isolation from the rest of the dishwasher 10 for clarity purposes. Also illustrated is a sump plate 57 having a plate inlet 58, a lower assembly base 59, and a valve drive system 60, which includes a power unit 61 and a drive unit 62. Also illustrated is a diverter valve assembly 70 having a rotatable diverter valve element 71, which may be located within the liquid flow path and driven by the valve drive system 60, and a spray assembly drive system 80 for rotating the first lower spray assembly 34. The sump plate 57 defines a portion of the bottom wall 18, and therefore, defines a portion of the tub 14. The base inlet 58 may be formed in a portion of the sump plate 57 and may be fluidly coupled with the sump 30 through the pump assembly 32 and a conduit 58*a*.

The power unit 61 and drive unit 62 may be operably coupled with the diverter valve element 71. More specifically, the power unit 61 may be a motor 63, which supplies power or driving force to the drive unit 62. The motor 63 can be located outside the wash tub 14 (FIG. 2). The drive unit 62 may comprise a drive shaft 64 coupled between the motor 63 and the diverter valve element 71 and which uses the power from the motor 63 to drive the rotation of the diverter valve element 71. The diverter valve element 71 is rotated about a first axis of rotation 68 (FIG. 5) by the valve drive system 60 between multiple positions to selectively divert liquid flowing from the wash chamber 24 between the spray assemblies 34, 36, 38 and 40.

The diverter valve element 71 is illustrated as a rotatable diverter disk 72 having openings 73, which may align with one or more of the fluid passages 74*a*-74*c* in the lower assembly base 59 to selectively fluidly couple fluid in the sump 30 to the various spray assemblies 34, 36, 38 and 40 when the diverter disk 72 is rotated to one of the multiple positions. It has been contemplated that the diverter disk 72 may have one or more openings 73. The diverter disk 72 has been illustrated as having two openings 73, and the lower assembly base 59 has been illustrated as having thee fluid passages 74*a*-74*c*.

Figure 5:
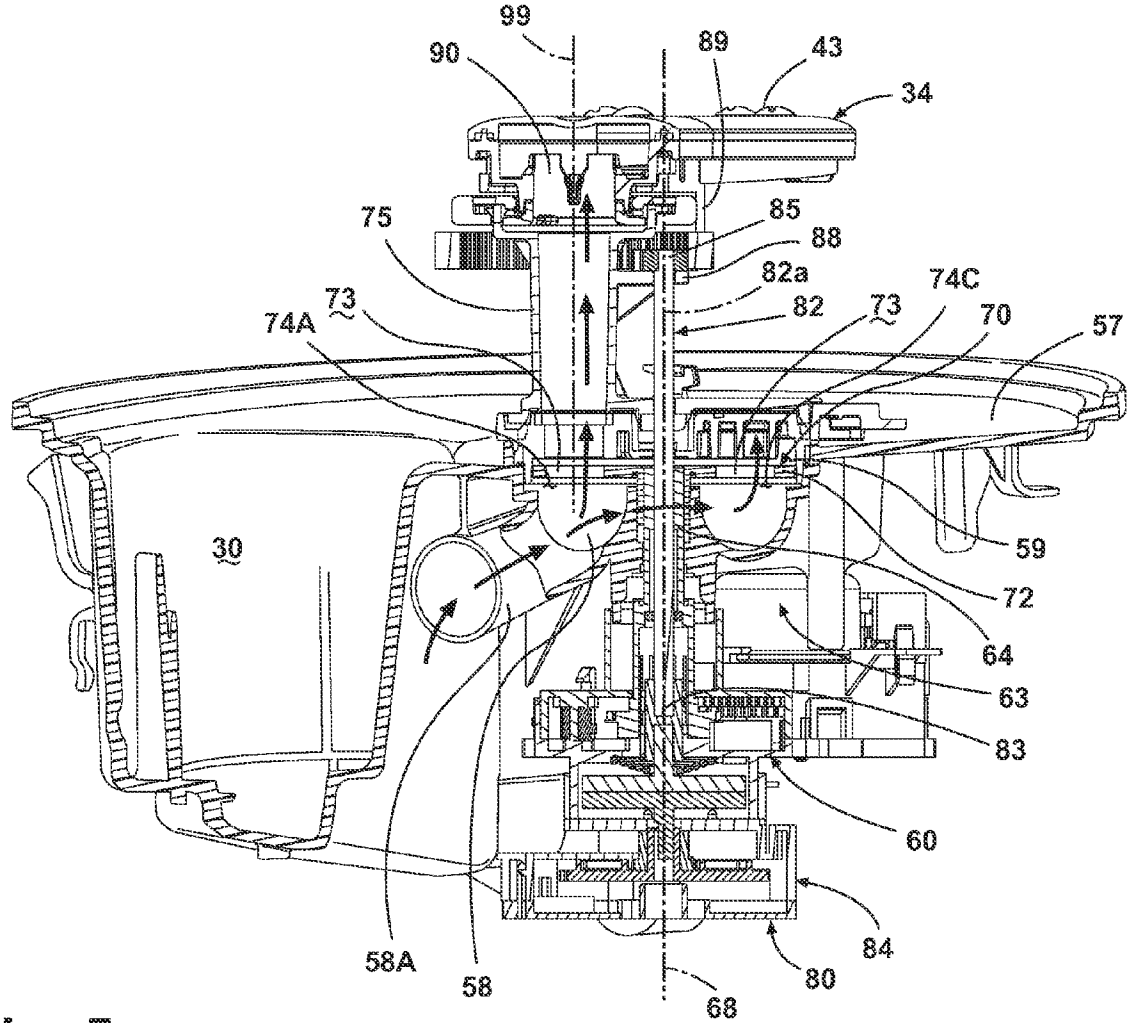
FIG. 5 is a cross-sectional view of the portion of the dishwasher illustrated in FIG. 3.

Referring to FIGS. 3-5, the drive shaft 64 may be operably coupled to the diverter disk 72 and operates to rotate the diverter disk 72 as the motor 63 drives the drive shaft 64. The openings 73 allow wash water to flow through the lower assembly base 59 and into one of the four spray assemblies 34, 36, 38 and 40 (FIGS. 1-2). Thus, movement of the diverter disk 72 between its multiple positions allows selective fluid coupling of the wash liquid in the sump 30 and the various spray assemblies 34, 36, 38 and 40.

For example, a lower spray attachment 75 extends vertically from the fluid passage 74*a* in the lower assembly base 59 to the first lower spray assembly 34. Thus, the lower spray attachment 75 may fluidly couple the fluid passage 74*a* to the first lower spray assembly 34. The first lower spray assembly 34 may be rotatably mounted on the lower spray attachment 75. Multiple conduits 76, 77 may align with the other fluid passages 74*b*, 74*c* and extend from other fluid passages 74*b*, 74*c* in the lower assembly base 59 to the second lower spray assembly 36 and the supply tube 42, respectively (FIG. 2).

FIG. 4 is an exploded view of the parts making up the sump 30, pump assembly 32, first lower spray assembly 34, lower assembly base 59, valve drive system 60, diverter valve assembly 70, and a spray assembly drive system 80. As can be more easily seen in this view, the spray assembly drive system 80 includes a drive shaft 82, a motor 84, and a gear train comprising a drive gear 86 and an outer ring gear 87.

Referring to FIGS. 4-5, the drive shaft 64 is illustrated as having a central opening 78 for passage of the drive shaft 82. The drive shaft 82 may be received within the central opening 78 of the drive shaft 64 such that it is free to rotate within the central opening 78 about a second axis 82*a*. As illustrated, the first axis of rotation 68 and the second axis 82*a* are coaxial to partially integrate the diverter valve assembly 70 and the spray assembly drive system 80 to provide a compact configuration which may result in a larger usable space in the dishwasher 10 for other components.

The drive shaft 82 has a lower portion 83, which may be operably coupled to the motor 84 such that rotation of the motor 84 will rotate the drive shaft 82. The motor 84 may operate to rotate the drive shaft 82 independently of the movement of the drive shaft 64. Further, the motor 84 may be able to operate in both a forward and reverse direction.

The drive shaft 82 has an upper portion 85 that extends through the central opening 78 of the drive shaft 64, through the sump plate 57, which forms a portion of the bottom wall 18, and into the lower portion of the wash tub 14. The upper portion 85 may be received within a holder 88 that may be attached to a portion of the lower spray attachment 75, such that the upper portion 85 is free to rotate within the holder 88. The upper portion 85 may be operably coupled to the drive gear 86. The drive gear 86 may in turn be enmeshed with the outer ring gear 87. The ring gear 87 may have an upwardly extending support 89 that may be operably coupled to the first lower spray assembly 34 such that rotational movement of the ring gear 87 and the support 89 may be transferred to the first lower spray assembly 34 to rotate the first lower spray assembly 34. The first lower spray assembly 34 may rotate about a third axis of rotation 99. The lower spray attachment 75 may also be aligned with this third axis 99 to provide a compact configuration. The support 89 may take many forms; as illustrated, the support 89 may include a fluid passageway 90 which may provide fluidly communication between the lower spray attachment 75 and the first lower spray assembly 34.

Looking at the spray assembly drive system 80 in more detail, the drive shaft 82 has an axis of rotation 82*a* which is offset from an axis of rotation 99 of the first lower spray assembly 34. As the drive shaft 82 is rotated the drive gear 86 is rotated. The rotational motion of the drive gear 86 causes the ring gear 87 to rotate. The ring gear 87 is constrained from rotating eccentrically by the lower spray attachment 75 and instead rotates about a third axis 99. The first lower spray assembly 34, which is operably coupled with the ring gear 87 through the support 89 rotates with the ring gear 87. As one entire rotation of the drive gear 86 only completes a partial rotation of the ring gear 87 the RPM of the first lower spray assembly 34 is reduce compared to the output RPM of the motor 84. Although the gear train shown has a drive and ring gear 86, 87, it has been contemplated that other types of gear assemblies could be used.

Referring to FIG. 5, when the diverter valve assembly 70 is assembled, it provides for fluid paths, as shown by the arrows, from the sump 30 to at least one of the spray assemblies 34, 36, 38 and 40. The fluid paths are formed by the complementary fluid passages 74*a*-74*c* in the lower assembly base 59, openings 73 in the diverter disk 72, and either the lower spray attachment 75 or conduits 76, 77 (FIG. 3). The movement of the openings 73 relative to the fluid passages 74*a*-74*c* selectively fluidly connects the plate inlet 58, which is connected to the sump 30 through the pump assembly 32 and conduit 58*a*, to one or more of the spray assemblies 34, 36, 38 and 40.

During operation of the dishwasher 10, the diverter valve assembly 70 may be employed to control the volume of the stream of liquid from the pump assembly 32 to each of the spray assemblies 34, 36, 38 and 40. At an appropriate time during the cleaning cycle to spray wash liquid into the wash chamber 24, the controller 55 signals the pump assembly 32 to supply wash liquid to the valve assembly 70. Depending upon the cycle of operation being run, the controller 55 may also operate either of the drive systems 60 and 80.

Activation of the motor 63 of the valve drive system 60 by the controller 55 turns the drive shaft 64, which in turn causes the rotatable diverter disk 72 to turn. Movement of the rotatable diverter disk 72 rotates the openings 73 to fluidly connect the plate inlet 58 with the different fluid passages 74*a*-74*c* in the lower base assembly 59, which is accomplished by aligning or partially aligning one or more of the openings 73 with one or more of the fluid passages 74*a*-74*c*. The amount of time that the openings 73 are fluidly connected with each of the fluid passages 74*a*-74*c* controls the duration of time that each of the various spray assemblies 34, 36, 38 and 40 sprays liquid. After achieving the desired fluid coupling of one or more spray assemblies 34, 36, 38 and 40 with the pump 32, the motor 63 may be deactivated so that fluid coupling may be maintained, or may be continued to rotate the drive shaft 64 such that each of the spray assemblies 34, 36, 38 and 40 is sequentially coupled with the sump 30. It should be noted that the supply tube 42 feeds water to both the rotating mid-level spray assembly 38 and the upper spray assembly 40. Thus, an additional valve (not shown) may be included to divert water to one or the other. Alternatively, a portion of the wash liquid from the supply tube 42 may go to each of the spray assemblies 38, 40.

During operation of the dishwasher 10, the controller 55 may also be employed to control the operation of the motor 84 of the spray assembly drive system 80 which in turn results in rotation of the drive shaft 82. The drive gear 86 and ring gear 87 form a gear train, which couples the drive shaft 82 to the first lower spray assembly 34 such that rotation of the drive shaft 82 about the second axis 82*a* effects rotation of first lower spray assembly 34 about the third axis 99 via the gear train. The motor 84 and other components of the spray assembly drive system 80 may be able to operate in both a forward and reverse direction; thus, the first lower spray assembly 34 may be driven in both a first rotational direction and in a second rotational direction opposite from the first rotational direction. This bi-directional rotation may help to clean utensils in the lower rack 28. The controller 55 may control the time the motor 84 is operated in each direction. Further, the controller 55 may operate the motor 84 to slow or even stop the first lower spray assembly 34. Slowing or stopping the rotation of the first lower spray assembly 34 may allow for better cleaning in certain areas of the wash chamber 24. During this time, the controller 55 may also operate the pump assembly 32 to deliver liquid to one or more of the spray arm assemblies 34, 36, 38 and 40. Thus, the rotation of the first lower spray assembly 34 may be stopped while the pump assembly 32 is delivering liquid to the first lower spray assembly 34.

Figure 6:
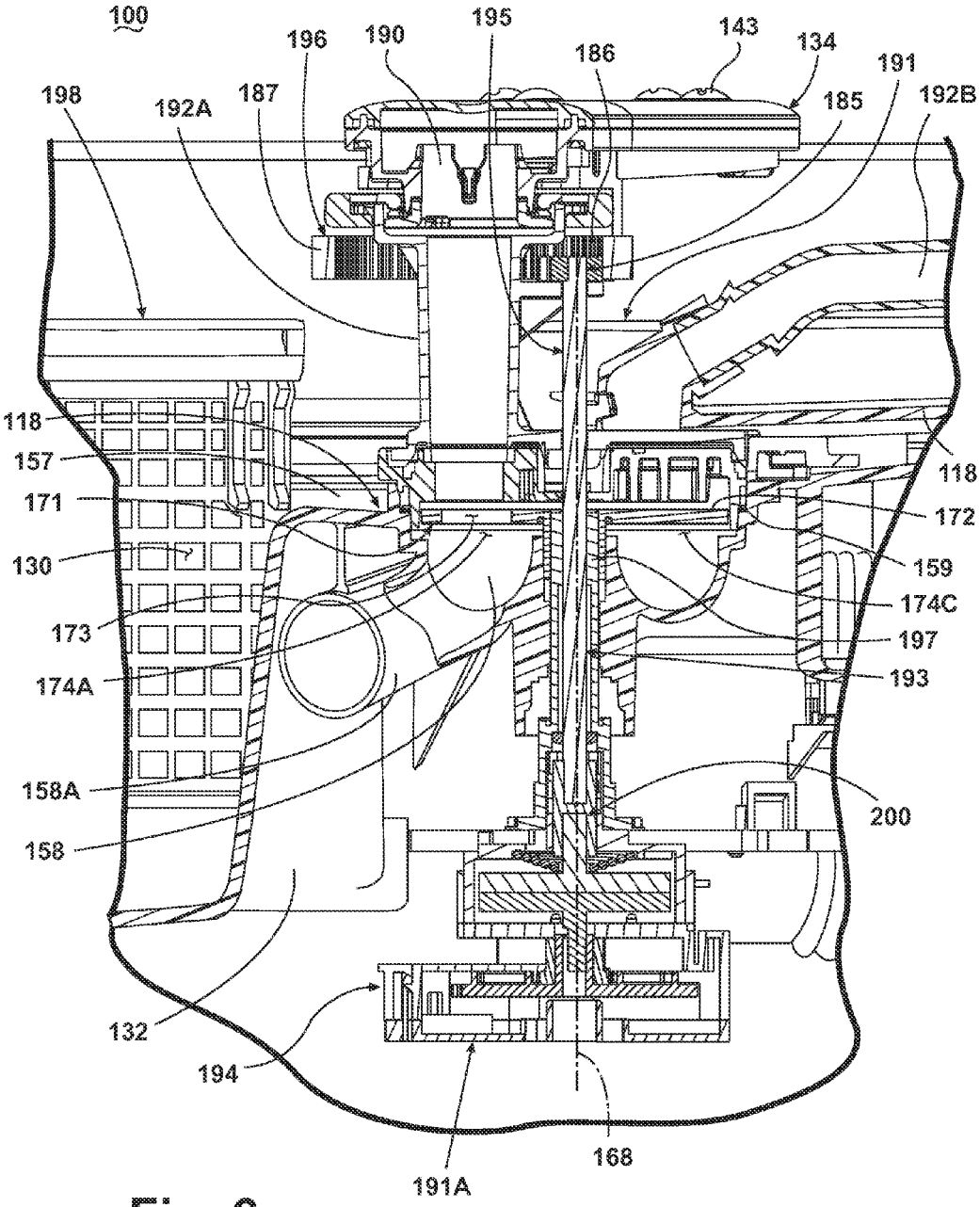
FIG. 6 is a cut away view of a lower portion of a dishwasher in accordance with a second embodiment of the invention with a valve element in a first position.
Figure 7:
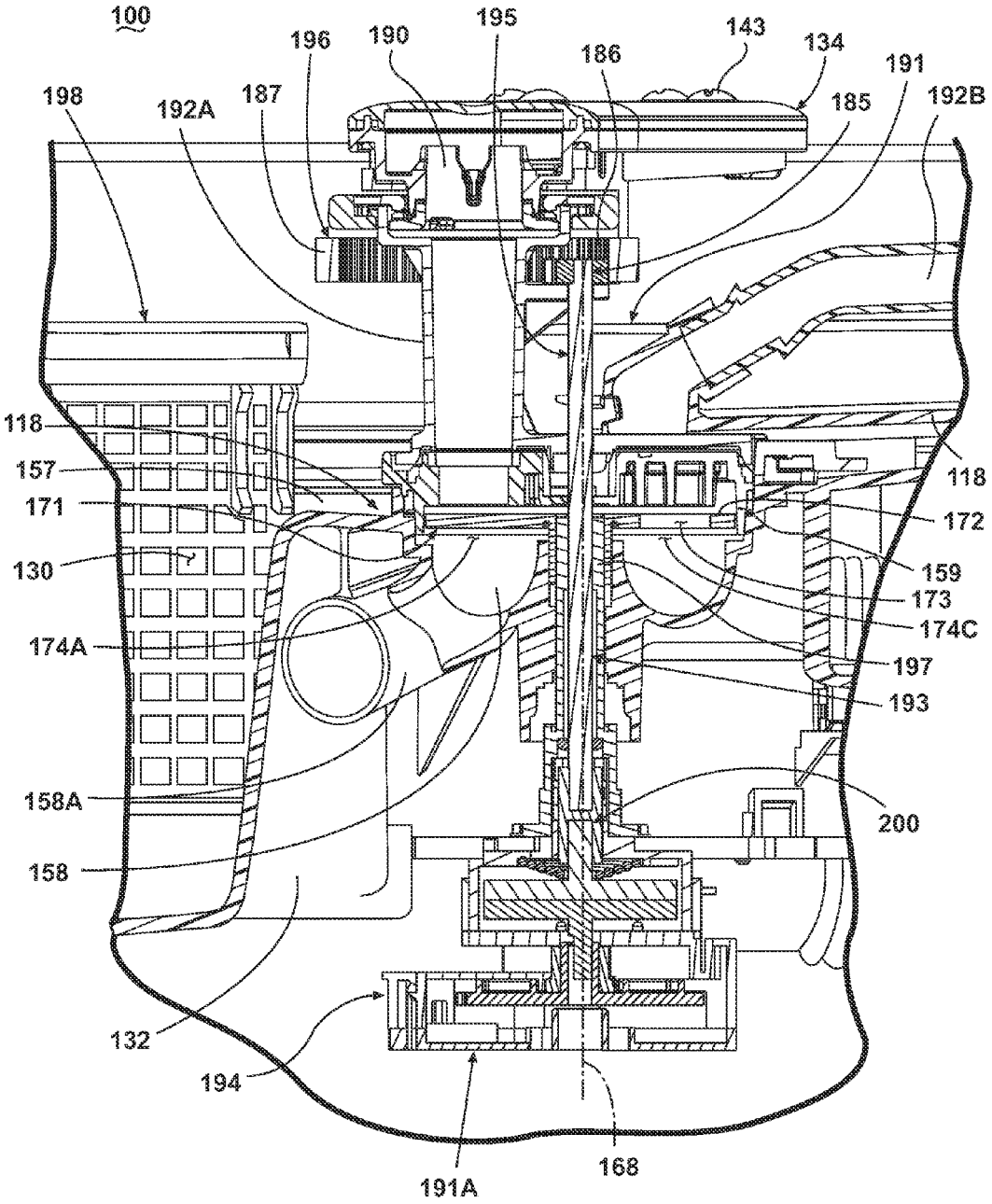
FIG. 7 is a cut away view of the lower portion of the dishwasher in accordance with the second embodiment of the invention with the valve element in a second position.

FIGS. 6 and 7 illustrate a dishwasher 100 according to a second embodiment of the invention. The second embodiment 100 is similar to the first embodiment 10. Therefore, like parts will be identified with like numerals increased by 100, with it being understood that the description of the like parts of the first embodiment applies to the second embodiment, unless otherwise noted.

One difference between the first embodiment and the second embodiment is that the dishwasher 100 has a sump assembly which includes the recess defining the sump 130, a liquid recirculation system having a diversion header 191, and a single drive system 191*a* to drive both the valve element 171 and the first lower spray assembly 134. The pump assembly 132 fluidly couples the sump 130 to the diversion header 191 via an inlet conduit 158*a* coupled at one end to an outlet of the pump 132 and at the other end to the plate inlet 158. The sump assembly has an upper surface or sump plate 157, which defines a portion of the bottom wall 118, and the diversion header 191 extends above the sump plate 157. More specifically, the diversion header 191 has been illustrated as a dome projecting above the bottom wall 118, A first branch conduit 192*a* extends from the diversion header and fluidly couples the valve element 171 to the first lower spray assembly 134, and a second branch conduit 192*b* extends from the diversion header and fluidly couples the valve element 171 to the second lower spray assembly 136 (not shown). The valve element 171 is located within the diversion header 191 and is rotatable about a first axis of rotation 168 between at least a first position (FIG. 6) and a second position (FIG. 7) to selectively divert liquid flowing from the sump 130 to the first lower spray assembly 134 and the second lower spray assembly 136, respectively. The first and second branch conduits 175, 176 extend from the dome and above the bottom wall 118. As illustrated, the first branch conduit 175 extends vertically from the dome with the first lower spray assembly 134 being rotatably mounted to an upper portion of the first branch conduit 175 and the second branch conduit 176 extends radially from the dome and overlies the bottom wall 118.

The drive system 191*a* rotates the diverter valve element 171 to selectively divert liquid flowing from the sump 130 between the spray assemblies 34, 36, and also rotates the first lower spray assembly 134. The drive system 191*a* includes a common drive shaft 193 driven by a common motor 194 and operably coupled to both the first lower spray assembly 134 and the valve element 171. The selective actuation of the common drive shaft 193 rotates the first lower spray assembly 134 and rotates the valve element 171 between at least the first and second positions to selectively control the flow of liquid from the sump 130 to the first lower spray assembly 134 and the second lower spray assembly 136.

The common drive shaft 193 has been illustrated as including a shaft 195, which is operably coupled with the motor 194 at one end and to the first lower spray assembly 134 at the other end through a gear train 196, and a sleeve 197 which surrounds the shaft 195 and couples the shaft 195 to the valve element 171. It can be seen from FIG. 6 that the sleeve 197 lies entirely below the bottom wall 118 and the shaft 195 has a portion extending through and above the bottom wall 118. The portion of the shaft 195 extending above the bottom wall 118 is operably coupled to the first lower spray assembly 134 through the gear train 196 such that rotation of the shaft 195 by the motor 194 effects the movement of the first lower spray assembly 134. The dishwasher 100 has been illustrated as including a filter assembly 198, which may be removably located in the recess defining the sump 130. The gear train 196 is compact and substantially the same as the gear train in the first embodiment; no portion of the gear train 196 overlies the recess defining the sump 130 or the filter assembly 198.

Both the sleeve 197 and shaft 195 may be selectively operably coupled to the motor 194 by a clutch mechanism 200, which has been illustrated schematically in FIGS. 6 and 7. The clutch mechanism 200 may be operably coupled to the controller 155, and the controller 155 may actuate and deactuate the clutch mechanism 200 to affect the coupling and uncoupling of the shaft 195 and sleeve 197 with the motor 194. The clutch mechanism 200 may be actuated such that the shaft 195 is coupled together with the motor 194 or such that the sleeve 197 is coupled together with the motor 194. Alternatively, both the shaft 195 and the sleeve 197 may be coupled, by the clutch mechanism 200, with the motor 194 such that motor 194 will rotate both the shaft 195 and the sleeve 197.

In operation, if both the sleeve 197 and shaft 195 are coupled with the motor 194 when the motor is operated, both the shaft 195 and the sleeve 197 will rotate. As the shaft 195 rotates the movement is transferred through the gear train 196 and effects rotation of the first lower spray assembly 134. As the sleeve 197 rotates it effects rotation of the valve element 171 between at least a first position (FIG. 6) and a second position (FIG. 7). The sleeve 197 may continue to be coupled to the motor 194 such that liquid continues to be selectively diverted between the first lower spray assembly 134 and the second lower spray assembly 136 when the pump assembly 132 is operated. Alternatively, the sleeve 197 may be uncoupled from the motor 194 when the valve element 171 is in either the first position (FIG. 6) or the second position (FIG. 7).

It has been contemplated that the common drive shaft 193 may have an alternative structure, by way of a non-limiting example, the sleeve 197 may be directly coupled with the gear train 196, while the shaft 195 may be directly coupled the valve element 171. Further, it has also been contemplated that instead of using the clutch mechanism 200, a separate drive unit or motor may be operably coupled to the sleeve 197 and may operate to rotate the sleeve 197 independently of the movement of the shaft 195. In that manner, the shaft 195 and sleeve 197 could also be independently rotatable.

Traditional dishwasher spray arms rely on diverted wash water to provide hydraulic drive to rotate wash arms. This hydraulic drive is dependent on pump flow rate and pressure, and the wash arms may only be designed to run at nominal speeds for any given pump. These hydraulically-driven wash arms are also only uni-directional. It is not uncommon for hydraulically-driven spray arms to stall during portions of a cycle of operation, which may negatively impact cleaning performance. The embodiments of the invention described above allow the first lower spray assembly 34, 134 to be motor-driven, resulting in a more efficient method of driving the first lower spray assembly 34, 134, as well as permitting more control over its rotational speed and direction. Many useful spray strategies can be adopted when the position of the first lower spray assembly 34, 134 is controlled independently of the supply of liquid through the first lower spray assembly 34, 134. For example, the first lower spray assembly 34, 134 may be stopped or slowed at locations where a greater spraying is desired, such as when the first lower spray assembly 34, 134 is directed to the corners of the rack or areas having high soil amounts. This allows additional features, such as zonal washing, to be added to the wash cycle and the dishwasher. The ability to manipulate both the speed of rotation of the first lower spray assembly 34, 134 and the ability to reverse the direction of the first lower spray assembly 34, 134 results in improved wash coverage.

The embodiments of the invention described above also allow the controller to select which spray assemblies are to be operated during the cleaning cycle. In this manner, cleaning and resource usage may be optimized by spraying wash liquid only in areas occupied by utensils. This avoids wasted sprays of water and saves both time and energy.

While the invention has been specifically described in connection with certain specific embodiments thereof, it is to be understood that this is by way of illustration and not of limitation, and the scope of the appended claims should be construed as broadly as the prior art will permit. For example, it has been contemplated that the invention may differ from the configuration shown in FIGS. 1-6, such as by inclusion of other conduits, utensil racks, valves, spray assemblies, seals, and the like, to control the flow of wash liquid.

What is claimed is:

1. An automatic dishwasher for washing articles according to a cycle of operation, the dishwasher comprising:

a wash tub at least partially defining a wash chamber for receiving the articles for washing;

a first sprayer mounted within the wash chamber for movement within the wash chamber;

a second sprayer located within the wash chamber;

a liquid flow path fluidly coupling the wash chamber to the first sprayer and the second sprayer;

a diverter valve located within the liquid flow path and having a valve element rotatable about a first axis of rotation between first and second positions to selectively divert liquid flowing from the wash chamber between the first and second sprayers, respectively; and a drive system moving the first sprayer in the wash chamber and having a first drive shaft rotatable about a second axis of rotation and operably coupled to the first sprayer to effect movement of the first sprayer;

wherein the first axis of rotation and second axis of rotation are coaxial to partially integrate the diverter valve and the drive system to provide a compact configuration, wherein the diverter valve further comprises a second drive shaft coupled to the valve element such that rotation of the second drive shaft rotates the valve element between the first and second positions, and wherein one of the first and second drive shafts is received within the other of the first and second drive shafts.

2. The automatic dishwasher of claim 1 wherein the first sprayer comprises a rotatable sprayer mounted within the wash chamber for rotation about a third axis of rotation.

3. The automatic dishwasher of claim 2 wherein the drive system comprises a gear train coupling the drive shaft to the first sprayer such that rotation of the drive shaft about the second axis of rotation effects rotation of the first sprayer about the third axis of rotation via the gear train.

4. The automatic dishwasher of claim 1 wherein the first sprayer emits a spray field oriented primarily upwardly within the wash chamber to define a first wash zone.

5. The automatic dishwasher of claim 4 wherein the second sprayer emits a spray field oriented primarily laterally within the wash chamber to define a second wash zone.

6. The automatic dishwasher of claim 5 wherein the first and second wash zones intersect.

7. The automatic dishwasher of claim 1 further comprising a sump located in a lower portion of the wash chamber and forming a portion of the liquid flow path.

8. The automatic dishwasher of claim 1 wherein the first and second drive shafts are independently rotatable.

* * * * *